US006032790A

United States Patent [19]

Soutchkov et al.

[11] Patent Number: 6,032,790

[45] Date of Patent: Mar. 7, 2000

[54] DEVICE FOR HOLDING COINS

[76] Inventors: Vladimir Soutchkov; Vitaliy Sevryugin, both of 1781 74th St., Brooklyn, N.Y. 11204

[21] Appl. No.: 09/286,861

[22] Filed: Apr. 6, 1999

[51] Int. Cl.[7] ..... A45C 1/00

[52] U.S. Cl. ..... 206/0.83; 206/0.84; 206/782

[58] Field of Search ..... 206/0.8, 0.81, 206/0.82, 0.83, 0.84, 486, 775, 776, 777, 782

[56] References Cited

U.S. PATENT DOCUMENTS

| | | | |
|---|---|---|---|
| 4,402,399 | 9/1983 | Friess | 206/0.83 |
| 4,592,465 | 6/1986 | Stein | 206/0.83 |

*Primary Examiner*—Jacob K. Ackun
*Attorney, Agent, or Firm*—Ilya Zborovsky

[57] ABSTRACT

A device for holding a plurality of coins has outer sheets including at least one outer layer composed of transparent material, an intermediate layer arranged between the two outer sheets provided with a plurality of throughgoing openings for insertion of coins, and a unit for connecting the sheets with one another long edges of the sheets.

11 Claims, 2 Drawing Sheets

DEVICE FOR HOLDING COINS

BACKGROUND OF THE INVENTION

The present invention relates to a device for holding coins.

Devices of the above mentioned general type are known in the art. A known device usually is formed as a box in which coins can be arranged in certain locations and closed by a cover. The known devices have substantial disadvantages and can be further improved.

SUMMARY OF THE INVENTION

It is therefore an object of the present invention to provide a holding device which is a further improvement of existing devices.

In keeping with these objects and with others which will become apparent hereinafter, one feature of present invention resides, briefly stated, in a device for holding coins which has two outer sheets including one sheet which is transparent, and an intermediate sheet provided with a plurality of throughgoing openings for insertion of coins, wherein the intermediate sheet is somewhat elastic so that a coin can be inserted in each opening with slightly spreading the opening and therefore the material of the intermediate sheet springs back to tightly hold the coin in the opening.

When the device is designed in accordance with the present invention, it is easy to manufacture, convenient for use, and provides a display of coins arranged on the holding device.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
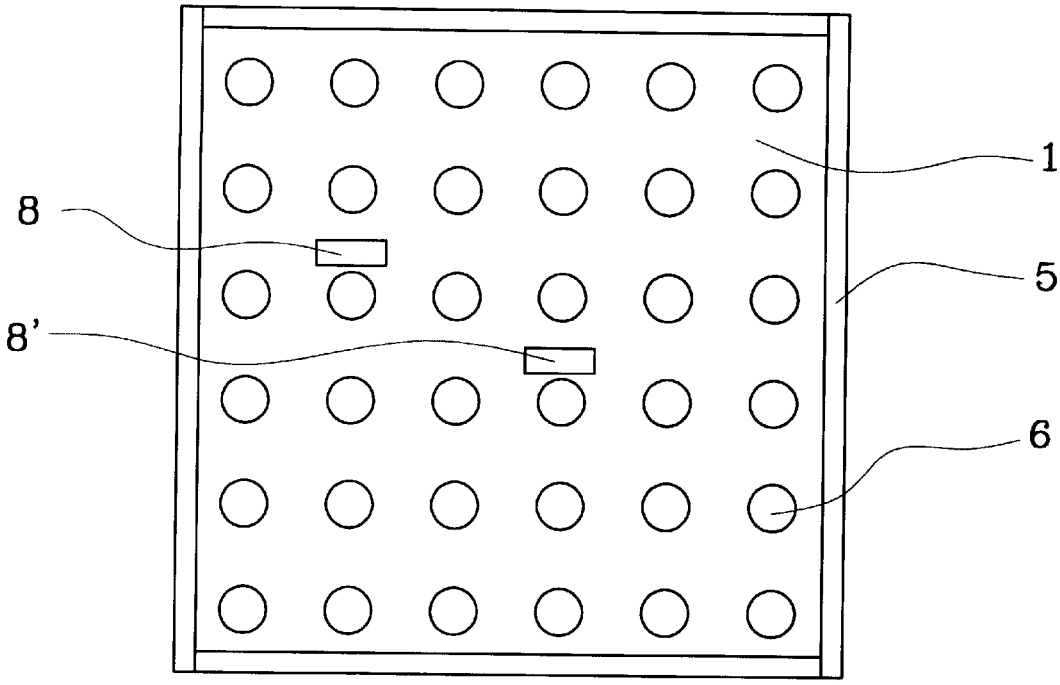
FIG. 1 is a front view of the device for holding coins in accordance with the present invention.

A device for holding coins in accordance with the present invention includes two outer sheets which are identified with reference numerals 1 and 2. At least one of the sheets can be transparent, for example composed of transparent plastic. It is to be understood that both outer sheets can be composed of a transparent material. The sheet can have a hole 10 for suspension on a nail and the like. The rear surface of the sheet 1 can be mirrored.

The device further has an intermediate sheet which is identified as a whole with reference numeral 3. The intermediate sheet is composed of a substantially elastic material, for example an elastic plastic. The intermediate sheet can be also made transparent. The intermediate sheet is provided with a plurality of throughgoing openings which are identified with reference numeral 4.

The thusly assembled three-sheet structure is held together by edge strips identified with reference numeral 5. Each edge strip can have an inverted U-shaped cross-section and can be composed of a springy material. Therefore each strip can be fitted on a corresponding one of the edges of the three-sheet structure 1, 2, 3 and slightly squeezed inwardly to hold the sheets in the region of the corresponding edge.

Figure 2:
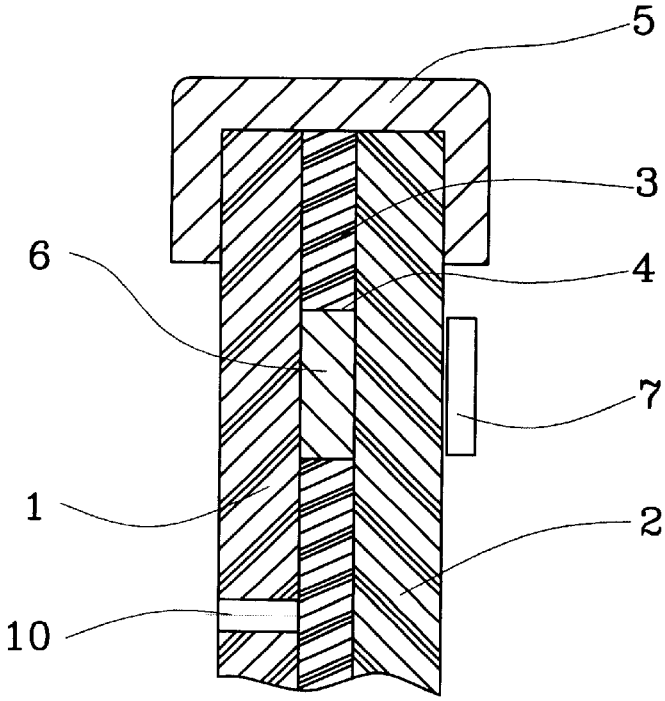
FIG. 2 is a view showing a cross-section of the inventive device in the region of one of its edges.

A plurality of coins can be inserted in the openings 4. The coins are identified with reference numeral 6. The size of the openings 4 is selected so that it is insignificantly smaller than the outer diameter of the coin 6. Therefore the coin is pushed into the opening 4 with a slight resistance, and thereafter the elastic material of the intermediate sheet 3 springs back and reliably holds the coin in the corresponding opening 4 as shown in FIG. 2.

Figure 3:
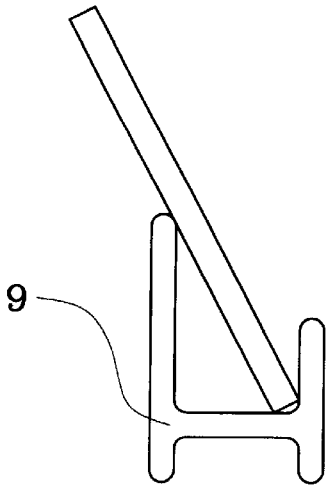
FIG. 3 is a view showing a device supported by an additional support.
Figure 4:
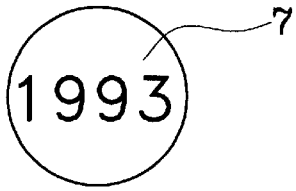
FIG. 4 is a view illustrating one of the attachment pieces identifying a year of the corresponding coin.
Figure 5:
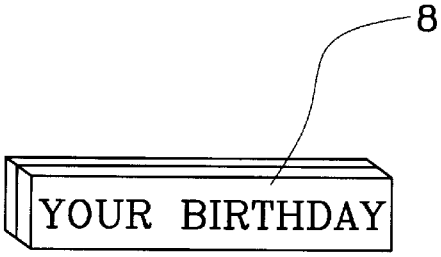
FIG. 5 is a view showing one of the labels identifying a corresponding events associated with the coin year.

In order to assemble the device the coins 6 are inserted in the throughgoing openings 4, the sheet 1 and 2 are placed at opposite sides of the intermediate sheet 3, and the strips 5 are fitted over the corresponding edges. The thusly assembled device can be supported on a support 9 as shown in FIG. 3. When all three sheets 1, 2 and 3 are transparent, the coins are clearly visible since all areas around the coins are transparent.

In accordance with a further feature of the present invention a plurality of attachment pieces 7 are provided. The attachment pieces 7 bear for example the symbols of years in which the corresponding coins were produced. The attachment pieces 7 can be provided with a rear adhesive layer, with which each attachment piece 7 is attached to the front sheet 2 in an area coinciding with a corresponding throughgoing opening 4 and therefore with a corresponding coin 6. Therefore the corresponding coin is identified by the attachment sheet.

In accordance with a further feature of the present invention, a plurality of labels 8 are provided. Each label carries a name of a corresponding event which occurred in corresponding year, for example birthdays, wedding anniversaries, graduations, etc. Each label can have a rear adhesive layer with which it is attached to the front sheet 2 in the area corresponding to a coin of the corresponding year. Also, labels 8 can carry identification of years of issue of the coins.

In accordance with another embodiment of the present invention, the device has exactly 100 throughgoing openings, and each throughgoing opening can have one cent produced in the corresponding year, so that the whole device contains 100 cents or in other words one dollar. Also, the cents are selected starting from the year 1901 to the year 2000, to symbolize the whole twentieth century.

Figure 6A:
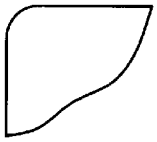
FIGS. 6*a* and 6*b* are views showing corners of elements of the device.
Figure 6B:
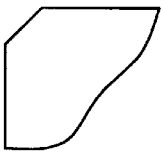

The corners of elements 1, 2, 3 can be rounded or chamfers as shown in FIGS. 6*a*, 6*b*.

It will be understood that each of the elements described above, or two or more together, may also find a useful application in other types of constructions differing from the types described above.

While the invention has been illustrated and described as embodied in device for holding coins, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for holding a plurality of coins, comprising two cuter layers including at least one outer layer composed of a transparent material; an intermediate layer arranged between said two outer layers and provided with a plurality of throughgoing openings for insertion of coins; and means for connecting said layers with one another along edges of said layers, said intermediate layer being composed of an elastic transparent material which is stretchable in a plane of said intermediate layer and is springable back, so that when a coin having a greater size than a size of each of said openings is to be inserted into a corresponding one of said opening, the coin is pushed into a corresponding one of said openings with a slight resistance, the elastic material of said intermediate layer yields in an area around said one opening in the plane of said intermediate layer so that a size of said one opening increases to allow insertion of the coin in said one opening without bending of said intermediate layer transversely to the plane of said intermediate layer, and thereafter the elastic material of said intermediate layer springs back in the plane of said intermediate layer and reliably holds the corresponding coin.

2. A device as defined in claim 1, wherein both said outer layers are composed of a transparent material.

3. A device as defined in claim 1, wherein said means for connecting said layers with one another include a plurality of edge strips fitted over a respective one of said edges of said layers.

4. A device as defined in claim 3, wherein each of said edge strips has an inverted U-shaped cross-section and is springy in a transverse direction.

5. A device as defined in claim 1, and further comprising a plurality of attachment pieces having information about years and attachable on one of said outer layers in an area corresponding to an opening carrying a coin made in a corresponding year.

6. A device as defined in claim 5, wherein each of said attachment pieces has means for attaching said attachment pieces to said one outer layer, said attaching means being adhesive.

7. A device as defined in claim 1, and further comprising a plurality of labels attachable to at least one of said outer layers and bearing names of events which occur in corresponding years, each of said labels being attachable in an area corresponding to a throughgoing opening in which a coin made in a corresponding year is inserted.

8. A device as defined in claim 7, wherein each of said labels is provided with means for attaching to said one outer sheet, said attaching means being adhesive.

9. A device as defined in claim 1, wherein said intermediate layer has 100 of said throughgoing openings in order to accommodate 100 cents starting from the year 1901 to the year 2000 in order to accommodate in the device the coins covering the whole twentieth century.

10. A device as defined in claim 1, wherein said outer layers include an inner layer provided with suspension hole.

11. A device as defined in claim 1, wherein said layers have rounded or chamfered corners.

* * * * *